US012208979B2

(12) United States Patent
Tanaka

(10) Patent No.: US 12,208,979 B2
(45) Date of Patent: Jan. 28, 2025

(54) FEEDING DEVICE AND IMAGE FORMING APPARATUS INCORPORATING SAME

(71) Applicant: Mizuna Tanaka, Tokyo (JP)

(72) Inventor: Mizuna Tanaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 17/988,074

(22) Filed: Nov. 16, 2022

(65) Prior Publication Data

US 2023/0257220 A1 Aug. 17, 2023

(30) Foreign Application Priority Data

Feb. 16, 2022 (JP) ..... 2022-022246

(51) Int. Cl.
*B65H 1/18* (2006.01)
*B65H 1/12* (2006.01)
*B65H 3/06* (2006.01)

(52) U.S. Cl.
CPC ..... *B65H 1/18* (2013.01); *B65H 1/12* (2013.01); *B65H 3/06* (2013.01); *B65H 2404/70* (2013.01)

(58) Field of Classification Search
CPC ... B65H 1/04; B65H 1/12; B65H 1/18; B65H 3/06; B65H 3/54; B65H 2404/70; B65H 2405/1142; B65H 2801/06
USPC ..... 271/121, 126, 127, 167, 169, 248
See application file for complete search history.

(56) References Cited

U.S. PATENT DOCUMENTS 3,893,663 A * 7/1975 Sanchez ..... B65H 3/56 271/169
5,016,865 A * 5/1991 Ioka ..... B65H 3/0808 271/103
5,248,138 A * 9/1993 Frank ..... B65H 1/04 271/171
11,479,434 B2 * 10/2022 Oshiro ..... B65H 1/04
2006/0180993 A1 * 8/2006 Lee ..... B65H 3/565 271/121
2008/0224385 A1 9/2008 Takahira et al.
(Continued)

FOREIGN PATENT DOCUMENTS

JP 5-085628 4/1993
JP 7-097071 4/1995
(Continued)

OTHER PUBLICATIONS

Espacenet machine translation of JP2006056653A; https://translationportal.epo.org/emtp/translate/?ACTION=description-retrieval&COUNTRY=JP&ENGINE=google&FORMAT=docdb&KIND=A&LOCALE=en_EP&NUMBER=2006056653&OPS=ops.epo.org/3.2&SRCLANG=ja&TRGLANG=en (Year: 2006).*

*Primary Examiner* — Leslie A Nicholson, III
(74) *Attorney, Agent, or Firm* — Harness, Dickey & Pierce, P.L.C.

(57) ABSTRACT

A feeding device includes a receptacle, a conveyor, an elastic member, and a load adjuster. The receptacle is vertically movable and holds a stack of sheets. The conveyor feeds an uppermost sheet of the stack of sheets on the receptacle in a feeding direction in which a sheet of the stack of sheets is fed. The elastic member biases the receptacle to press the uppermost sheet of the stack of sheets on the receptacle against the conveyor. At least when a height of the stack of sheets on the receptacle is equal to or greater than a given value, the load adjuster applies a reduced magnitude of load downward to the stack of sheets on the receptacle in response to a decrease in the height of the stack of sheets.

18 Claims, 5 Drawing Sheets

(56) References Cited

U.S. PATENT DOCUMENTS

| | | | |
|---|---|---|---|
| 2008/0237970 | A1 | 10/2008 | Tanaka et al. |
| 2009/0121418 | A1 | 5/2009 | Tanaka et al. |
| 2009/0315250 | A1 | 12/2009 | Kimura et al. |
| 2010/0059930 | A1 | 3/2010 | Tanaka et al. |
| 2012/0104690 | A1 | 5/2012 | Tanaka et al. |
| 2014/0319759 | A1 | 10/2014 | Fujii et al. |
| 2015/0274452 | A1 | 10/2015 | Tanaka et al. |
| 2021/0024305 | A1 | 1/2021 | Tanaka |
| 2021/0024317 | A1 | 1/2021 | Tanaka |

FOREIGN PATENT DOCUMENTS

| | | |
|---|---|---|
| JP | 2002-240966 | 8/2002 |
| JP | 2006-056653 | 3/2006 |

* cited by examiner

FEEDING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2022-022246, filed on Feb. 16, 2022, in the Japan Patent Office, the entire disclosure of which is hereby incorporated by reference herein.

BACKGROUND

Technical Field

Embodiments of the present disclosure generally relate to a feeding device and an image forming apparatus incorporating the feeding device, and more particularly, to a feeding device that feeds a sheet such as a sheet of paper, a transfer sheet, or a document, and to an image forming apparatus that forms an image on a recording medium such as a copier, a printer, a facsimile machine, or a multifunction peripheral having at least two of copying, printing, scanning, facsimile, and plotter functions.

Related Art

Some techniques are known in the art to feed, with a conveyor such as a pickup roller, an uppermost sheet of a stack of sheets on a vertically movable receptacle or bottom plate that is biased upward by an elastic member to press the uppermost sheet against the conveyor.

Some other techniques are known in the art to provide a side sheet guide or side fence with an inclination restraint having napped bristles, to prevent an uppermost sheet of a stack of sheets on a receptacle or input tray from being fed while floating and being skewed.

SUMMARY

In one embodiment of the present disclosure, a novel feeding device includes a receptacle, a conveyor, an elastic member, and a load adjuster. The receptacle is vertically movable and holds a stack of sheets. The conveyor feeds an uppermost sheet of the stack of sheets on the receptacle in a feeding direction in which a sheet of the stack of sheets is fed. The elastic member biases the receptacle to press the uppermost sheet of the stack of sheets on the receptacle against the conveyor. At least when a height of the stack of sheets on the receptacle is equal to or greater than a given value, the load adjuster applies a reduced magnitude of load downward to the stack of sheets on the receptacle in response to a decrease in the height of the stack of sheets.

Also described is a novel image forming apparatus incorporating the feeding device described above.

In another embodiment of the present disclosure, a novel feeding device includes a receptacle, a conveyor, an elastic member, and a load applier. The receptacle is vertically movable and holds a stack of sheets. The conveyor feeds an uppermost sheet of the stack of sheets on the receptacle in a feeding direction in which a sheet of the stack of sheets is fed. The elastic member biases the receptacle to press the uppermost sheet of the stack of sheets on the receptacle against the conveyor. The load applier applies a load to reduce a force that presses the uppermost sheet against the conveyor at least when a height of the stack of sheets on the receptacle is equal to or greater than a given value. The load applier changes the load to the stack of sheets on the receptacle depending on the height of the stack of sheets.

Also described is a novel image forming apparatus incorporating the feeding device described above.

In yet another embodiment of the present disclosure, a novel feeding device includes a receptacle, a pair of side fences, a conveyor, an elastic member, and a brush. The receptacle is vertically movable and holds a stack of sheets. Each of the side fences includes a fence face that contacts a side end face of the stack of sheets on the receptacle. The conveyor feeds an uppermost sheet of the stack of sheets on the receptacle in a feeding direction in which a sheet of the stack of sheets is fed. The elastic member biases the receptacle to press the uppermost sheet of the stack of sheets on the receptacle against the conveyor. The brush includes bristles inclined downward. The brush is disposed on the fence face of each of the side fences to contact the stack of sheets on the receptacle when the height of the stack of sheets on the receptacle is equal to or greater than the given value.

Also described is a novel image forming apparatus incorporating the feeding device described above.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
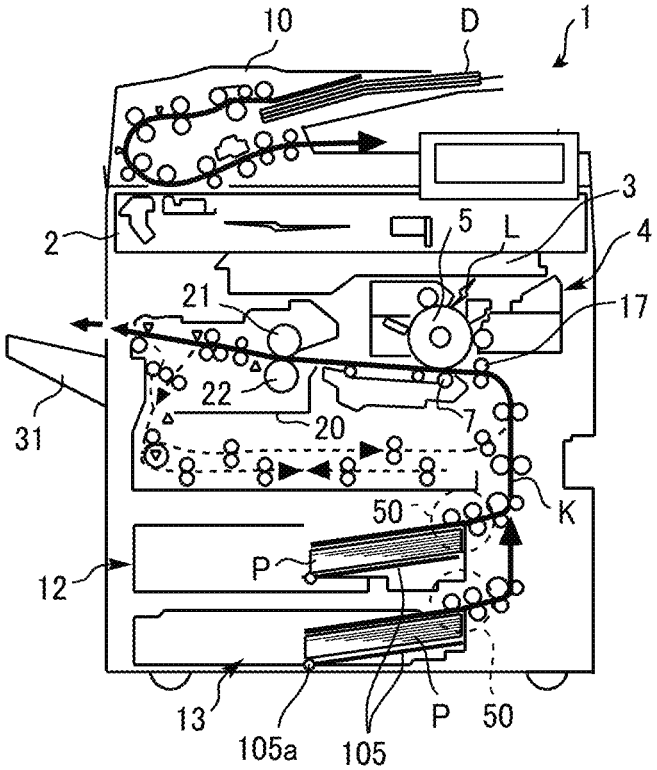
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are simplified or omitted unless otherwise required.

Initially with reference to FIG. 1, a description is given of the overall configuration and operation of an image forming apparatus 1 according to an embodiment of the present disclosure.

FIG. 1 is a schematic view of the image forming apparatus 1, which is a copier according to the present embodiment. In another embodiment of the present disclosure, the image forming apparatus 1 may be, for example, a printer, a facsimile machine, or a multifunction peripheral (MFP) having at least two of copying, printing, scanning, facsimile, and plotter functions.

In FIG. 1, the image forming apparatus 1 includes a document reading device 2, an exposure device 3, an image forming device 4, a transfer device 7 serving as an image forming unit, a document conveying device 10, feeding devices 12 and 13, a registration roller pair 17 serving as a conveyance roller pair, a fixing device 20, and an output tray 31. The document reading device 2 optically reads image data of a document D. The exposure device 3 irradiates a photoconductor 5, which is included in the image forming device 4, with exposure light L according to the image data read by the document reading device 2. The image forming device 4 forms a toner image on the photoconductor 5. The transfer device 7 transfers the toner image from the photoconductor 5 onto a sheet P.

The document conveying device 10 is an automatic document feeder (ADF) that conveys the document D placed on the document conveying device 10 to the document reading device 2. Each of the feeding devices 12 and 13 feeds the sheet P accommodated in the corresponding input tray.

The registration roller pair 17 conveys the sheet P toward the transfer device 7. The fixing device 7 includes a fixing roller 21 and a pressure roller 22 to fix the toner image borne as an unfixed image on the sheet P. The sheet P is ejected from a body of the image forming apparatus 1 onto the output tray 31.

Each of the feeding devices 12 and 13 includes a vertically movable receptacle 105 and a sheet feeding assembly 50 serving as a sheet feeder.

With continued reference to FIG. 1, a description is now given of a typical image forming operation of the image forming apparatus 1.

Firstly, multiple rollers of the document conveying device 10 convey or feed the document D from a document tray in a direction indicated by arrow in FIG. 1. The document D thus conveyed passes over the document reading device 2. At this time, the document reading device 2 optically reads image data of the document D passing over the document reading device 2.

The image data optically read by the document reading device 2 is converted into electrical signals. The electrical signals are transmitted to the exposure device 3 serving as a writer. The exposure device 3 then emits the exposure light L such as laser light according to the electrical signals (i.e., the image data) toward the surface of the photoconductor 5 of the image forming device 4.

While the photoconductor 5 rotates clockwise in FIG. 1, the image forming device 4 performs a given series of image forming processes, such as a charging process, an exposing process, and a developing process, to form a toner image corresponding to the image data on the photoconductor 5.

Thereafter, the transfer device 7 serving as an image forming unit transfers the toner image from the surface of the photoconductor 5 onto the sheet P conveyed by the registration roller pair 17.

Now, a description is given of how the sheet P is conveyed to the transfer device 7 serving as an image forming unit.

One of the feeding devices 12 and 13 disposed inside the body of the image forming apparatus 1 is selected automatically or manually. For example, the lower feeding device 13 is selected. Then, the sheet feeding assembly 50 feeds the uppermost sheet P of the sheets P accommodated in the feeding device 13 toward a conveyance passage K. The sheet P thus fed passes through the conveyance passage K along which multiple sheet conveyance rollers are disposed and reaches the position where the registration roller pair 17 is located. When the sheet P reaches the registration roller pair 17, the rotation of the registration roller pair 17 has been stopped. As a leading end of the sheet P contacts an area of contact between the rollers of the registration roller pair 17, the skew of the sheet P is corrected.

The activation of rotation of the registration roller pair 17 is timed to convey the sheet P of which the skew is corrected toward the transfer device 7 serving as an image forming unit such that the sheet P meets the image formed on the photoconductor 5 at an area of contact between the photoconductor 5 and the transfer device 7.

After the transfer device 7 transfers the toner image from the photoconductor 5 onto the sheet P in the transfer process, the sheet P passing between the photoconductor 5 and the transfer device 7 reaches the fixing device 20 through the conveyance passage K. In the fixing device 20, the sheet P is heated by the fixing roller 21 and pressed by the fixing roller 21 and the pressure roller 22 while the sheet P is conveyed through an area of contact, which may be referred to as a fixing nip, between the fixing roller 21 and the pressure roller 22. Thus, the fixing device 20 fixes the toner image onto the sheet P at the fixing nip in the fixing process. After the sheet P bearing the toner image fixed in the fixing process is conveyed out from the fixing nip between the fixing roller 21 and the pressure roller 22, the sheet P is output from the body of the image forming apparatus 1 onto the output tray 31 as an output image.

Thus, a series of image forming processes is completed.

Figure 2:
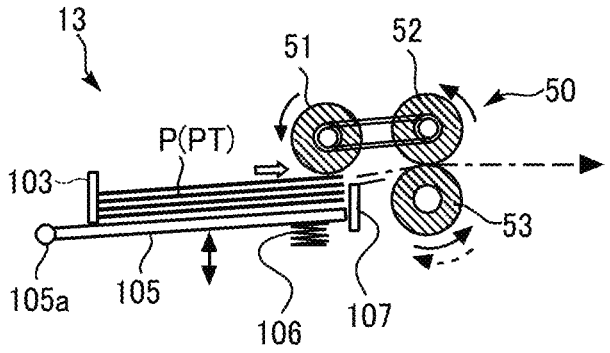
FIG. 2 is a schematic view of a feeding device according to an embodiment of the present disclosure.
Figure 3:
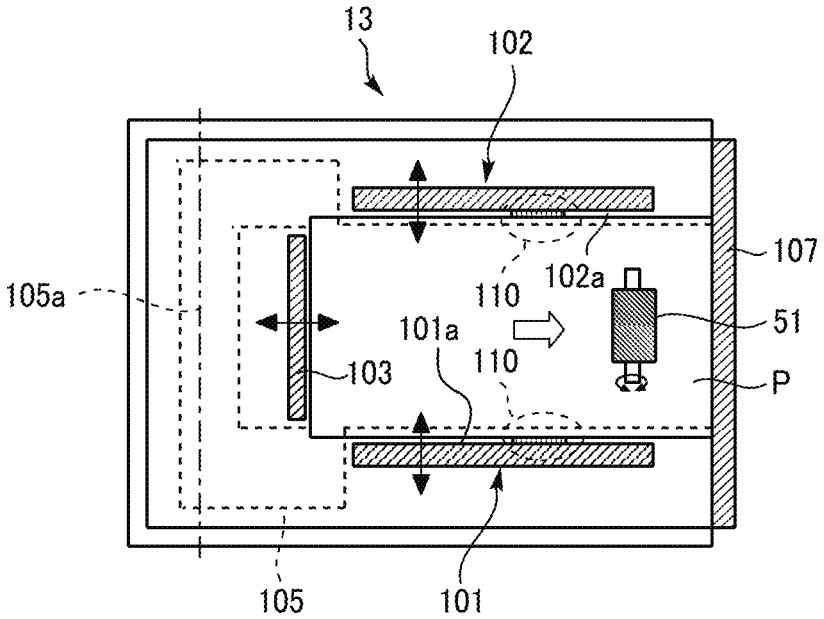
FIG. 3 is a top view of the feeding device of FIG. 2.

Referring now to FIGS. 2 and 3, a detailed description is given of the feeding devices 12 and 13 according to the present embodiment.

As an example, a description is now given of the lower feeding device 13 of the feeding devices 12 and 13 disposed in the body of the image forming apparatus 1. Although the feeding devices 12 and 13 are disposed at different locations, the feeding devices 12 and 13 have like configurations. For this reason, a redundant description of the configuration of the upper feeding device 12 is herein omitted unless otherwise required.

Referring to FIGS. 2 and 3, the feeding device 13 includes the receptacle 105 as a bottom plate, a sheet feeding assembly 50, a pair of side fences 101 and 102, an end fence 103, a reference fence 107, and a spring 106 serving as an elastic member. The receptacle 105 can hold a stack of sheets P, which may be referred to as a sheet bundle PT. The feeding assembly 50 feeds the sheet P placed on the receptacle 105.

The receptacle 105 is movable up and down such that a downstream side (right side in FIG. 2) in a feeding direction of the uppermost sheet P of the sheets P placed on the receptacle 105 reaches a given height position, which is a position where the uppermost sheet P contacts a pickup roller 51. Note that the feeding direction of the sheet P is a direction in which the sheet P is fed and may be referred simply as the feeding direction in the following description.

Specifically, the receptacle 105 is supported so as to be pivotable about a pivot 105*a* inside the feeding device 13. The receptacle 105 is pivoted in forward and reverse directions about the pivot 105*a* that is located at an upstream end of the receptacle 105 in the feeding direction. Thus, the receptacle 105 moves up and down.

Referring to FIG. 2, the sheet feeding assembly 50 includes, for example, a feed roller 52, the pickup roller 51 serving as a conveyor, and a separation roller 53.

The feed roller 52 is close to and downstream from a leading end of the sheets P placed on the receptacle 105 in the feeding direction indicated by thick arrow in FIG. 2. The feed roller 52 rotates counterclockwise in FIG. 2 along the feeding direction of the sheet P in contact with an upper face of the uppermost sheet P to feed the sheet P, together with the pickup roller 51, in the feeding direction indicated by dash-dot arrow in FIG. 2.

The pickup roller 51 as a conveyor rotates counterclockwise in FIG. 2 along the feeding direction in contact with the surface (i.e., the upper face) of the uppermost sheet P of the sheets P placed on the receptacle 105 to convey the uppermost sheet P toward the position of the feed roller 52.

The separation roller 53 is disposed to form an area of contact, which may be referred to as a nip, between the separation roller 53 and the feed roller 52. The separation roller 53 rotates in the forward direction, which is the clockwise direction indicated by dashed arrow in FIG. 2, along the feeding direction when one sheet P is sandwiched at the nip or when no sheet P is sandwiched at the nip. By contrast, when a plurality of sheets P is sandwiched at the nip, the separation roller 53 rotates in a direction opposite to the above-described forward direction. In other words, the separation roller 53 rotates in the counterclockwise direction indicated by solid arrow in FIG. 2. As a result, the uppermost sheet P of the plurality of sheets P sandwiched at the nip is fed in the feeding direction along the rotation of the feed roller 52 while the lower sheet or sheets P of the plurality of sheets P are conveyed in the direction opposite to the feeding direction (i.e., the forward direction). Thus, the multiple feeding of the sheets P is prevented.

The feeding device 13 according to the present embodiment includes the spring 106, which is a compression spring, as an elastic member that biases the receptacle 105 to press the uppermost sheet P of a stack of sheets P on the receptacle 105 against the pickup roller 51 serving as a conveyor.

Specifically, the spring 106 serving as an elastic member lifts up the receptacle 105 that is pivotable about the pivot 105*a* to press the uppermost sheet P of the stack of sheets P on the receptacle 105 against the pickup roller 51 that is secured at the given height position.

Such a configuration of the spring 106 moves up and down the receptacle 105 in the vertical direction, depending on a height H of the stack of sheets P (sheet bundle PT) on the receptacle 105 or the number of sheets P on the receptacle 105, so that the uppermost sheet P of the stack of sheets P on the receptacle 105 contacts the pickup roller 51. The pickup roller 51 feeds the uppermost sheet P of the sheets P on the receptacle 105 in the given feeding direction indicated by thick arrow in FIGS. 2 and 3.

In the present embodiment, the compression spring 106 is used as an elastic member that biases the receptacle 105 upward. However, the elastic member is not limited to the compression spring 106. Alternatively, the elastic member may be, for example, a tension spring, a torsion coil spring, or a plate spring. In the present embodiment, the receptacle 105 is directly biased by the elastic member (i.e., the spring 106). Alternatively, the receptacle 105 may be indirectly biased by the elastic member via another member.

In the present embodiment, the pickup roller 51 is secured at the given height position. Alternatively, the pickup roller 51 may be movable between the given height position (i.e., the position where the pickup roller 51 contacts the uppermost sheet P of the sheets P on the receptacle 105) and a retracted position where the pickup roller 51 is retracted upward from the given height position.

As illustrated in FIG. 3, the feeding device 13 according to the present embodiment includes the pair of side fences 101 and 102 that regulates the position of the sheet P placed on the receptacle 105 in a width direction of the sheet P, which is a direction perpendicular to the surface of the paper on which FIG. 2 is drawn and the vertical direction in FIG. 3. The side fences 101 and 102 are disposed at opposed widthwise ends of the sheet P so as to sandwich the sheet P. The side fences 101 and 102 can be moved by a manual moving assembly in conjunction with each other in the width direction of the sheet P so as to conform to the widthwise size of the sheet P. In short, the interval between the side fences 101 and 102 in the width direction of the sheet P can be increased or decreased.

The feeding device 13 according to the present embodiment further includes the reference fence 107 and the end fence 103 that regulate the position of the sheet P placed on the receptacle 105 in the feeding direction, which is the lateral direction in FIGS. 2 and 3. The reference fence 107 is disposed such that a downstream side face of the sheet P in the feeding direction (i.e., the leading end of the sheet P in the feeding direction) abuts against the reference fence 107. The end fence 103 is disposed to contact an upstream side face of the sheet P in the feeding direction (i.e., the trailing end of the sheet P in the feeding direction). The end fence 103 can be moved by the manual moving assembly in the feeding direction so as to conform to the size of the sheet P in the feeding direction.

In the feeding device 13 according to the present embodiment, the spring 106 serving as an elastic member stops biasing the receptacle 105 in conjunction with the receptacle 105, serving as an input tray that can hold a stack of sheets P, being pulled out from the body of the image forming apparatus 1. Such a configuration facilitates replenishment of the sheets P (sheet bundle PT) on the lowered empty receptacle 105 while the receptacle 105 serving as an input tray is pulled out from the body of the image forming apparatus 1. The spring 106 serving as an elastic member biases the receptacle 105 in conjunction with the attachment of the receptacle 105 serving as an input tray on which the sheets P (sheet bundle PT) are placed into the body of the image forming apparatus 1.

As illustrated in FIG. 2, the pickup roller 51 starts to rotate counterclockwise in contact with the upper face of the uppermost sheet P of the sheets P placed on the receptacle 105. At the same time, the feed roller 52 and the separation roller 53 start to rotate. As a result, the pickup roller 51 conveys the uppermost sheet P or upper sheets P of the sheet bundle PT placed on the receptacle 105 toward the nip between the feed roller 52 and the separation roller 53. At the nip, one sheet P is separated from other sheets P and conveyed toward the image forming unit by the feed roller 52 (and the pickup roller 51).

Referring now to FIGS. 2 to 7, a detailed description is given of a configuration and operation of the feeding device 13 of the image forming apparatus 1 according to the present embodiment.

As described above with reference to FIGS. 2 and 3, the feeding device 13 includes the receptacle 105, the pickup roller 51 serving as a conveyor, the spring 106 serving as an elastic member, and the pair of side fences 101 and 102.

The receptacle 105 as a bottom plate is movable up and down. A plurality of sheets P (sheet bundle PT) can be stacked on the receptacle 105. In other words, the receptacle 105 is vertically movable and can hold a stack of sheets P.

The pickup roller 51 functions as a conveyor that feeds the uppermost sheet P of the stack of sheets P on the receptacle 105 in the given feeding direction indicated by thick arrow in FIGS. 2 to 4C.

The spring 106 is an elastic member that biases the receptacle 105 to press the uppermost sheet P of the stack of sheets P on the receptacle 105 against the pickup roller 51 serving as a conveyor. The force that presses the sheet P against the pickup roller 51 as described above may be referred to as "feeding pressure (pickup pressure)."

Figure 5:
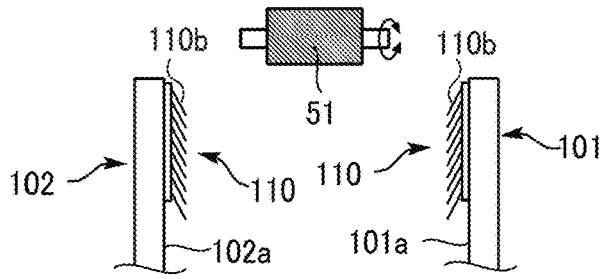
FIG. 5 is a partial view of an upstream side of the feeding device of FIG. 2 in a feeding direction.

As illustrated in FIGS. 3 and 5, the side fences 101 and 102 as a pair of fences include fence faces 101*a* and 102*a*, respectively. The fence faces 101*a* and 102*a* can contact side end faces of the stack of sheets P on the receptacle 105.

Referring to FIGS. 3 to 5, the feeding device 13 according to the present embodiment includes a brush 110, which is a brush-like member serving as a load adjuster.

At least when the height H of the stack of sheets P on the receptacle 105 is equal to or greater than a given value Hx, which is a value slightly smaller than a height H2 of the stack of sheets P described later with reference to FIG. 4B, the brush 110 functions as a load adjuster that reduces the magnitude of load applied downward, in a direction in which the feeding pressure is reduced, to the stack of sheets P on the receptacle 105, in response to a decrease in the height H.

In other words, at least when the height H of the stack of sheets P on the receptacle 105 is equal to or greater than the given value Hx, the brush 110 serving as a load adjuster gradually reduces the feeding pressure (pickup pressure) along with a gradual decrease in the height H due to a decrease in the number of sheets P as the sheets P are fed.

In the present description, the load adjuster (i.e., the brush 110) may be referred to as a load applier that applies a load to reduce the force that presses the uppermost sheet P against the conveyor (i.e., the pickup roller 51) when the height H of the stack of sheets P on the receptacle 105 is equal to or greater than the given value Hx. In the present embodiment, the brush 110 serving as the load applier changes the load to the stack of sheets P on the receptacle 105, depending on the height H of the stack of sheets P on the receptacle 105.

Thus, the brush 110 allows the feeding device 13 to stably feed the sheets P when the decrease in the height H or the number of sheets P stacked on the receptacle 105 along with the feeding of the sheets P reduces the feeding pressure (pickup pressure) applied to the pickup roller 51 from the uppermost sheet P of the sheets P on the receptacle 105 biased by the spring 106 serving as an elastic member.

Specifically, when the feeding pressure (pickup pressure) is excessively high, the sheets P may be fed at the same time due to an increased adhesion force caused by the friction between the sheets P. By contrast, when the feeding pressure (pickup pressure) is excessively low, the sheets P may fail to be fed due to an insufficient conveying force for feeding or conveying the sheet P.

Figure 6:
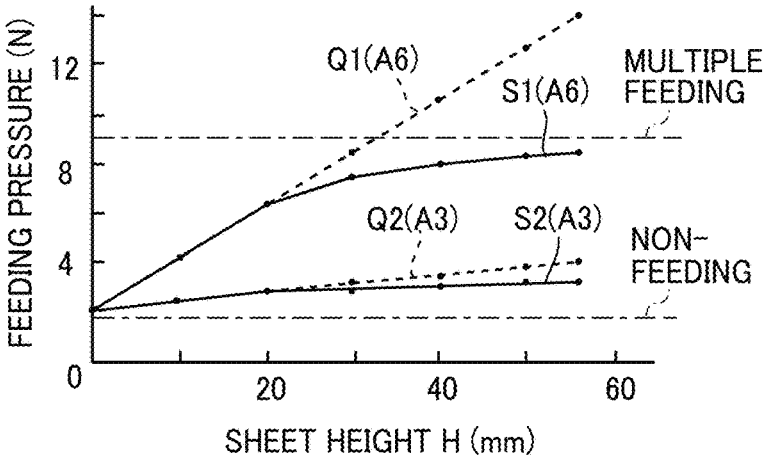
FIG. 6 is a graph illustrating a relationship between the height of a stack of sheets and a feeding pressure (pickup pressure) according to an embodiment of the present disclosure.
Figure 7:
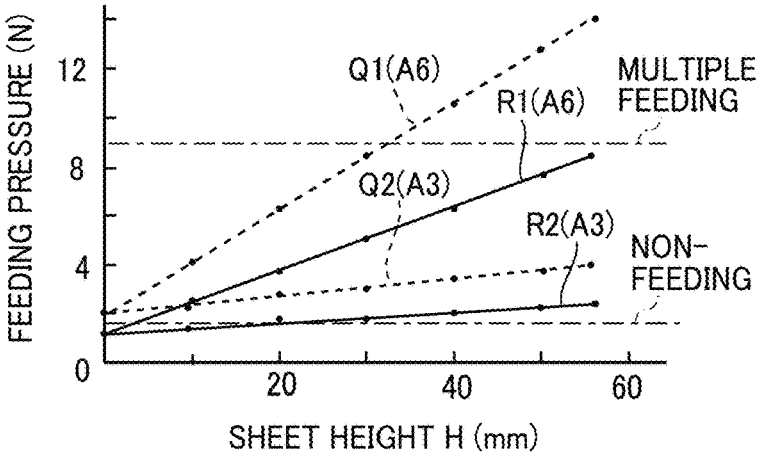
FIG. 7 is a graph illustrating a relationship between the height of a stack of sheets and a feeding pressure (pickup pressure) according to a comparative example.

Referring to FIGS. 6 and 7, in the present embodiment, an appropriate range of the feeding pressure (pickup pressure) that causes neither the multiple feeding nor non-feeding of the sheets P is from 1.5 N to 9 N.

The feeding pressure (pickup pressure) is generally obtained by subtracting the weight of the sheets P on the receptacle 105 and the weight of the receptacle 105 from the spring force of the spring 106 corresponding to the height H of the stack of sheets P on the receptacle 105. In the following description, the height H of the stack of sheets P on the receptacle 105 may be referred to simply as a sheet height H.

In short, referring to FIGS. 4A to 4C and FIG. 7, the feeding pressure (pickup pressure) decreases as the sheet height H decreases.

When smaller sheets P are stacked at the sheet height H, the feeding pressure (pickup pressure) increases because the smaller sheets P has a smaller weight. Specifically, referring to Q1 and Q2 (or R1 and R2) in the graph of FIG. 7, when the sheets P of the A6 size (small size) are stacked on the receptacle 105, the percentage of change (gradient) of the feeding pressure indicated by the vertical axis with respect to the sheet height H indicated by the horizontal axis is greater than that when the sheets P of the A3 size (large size) are stacked on the receptacle 105.

To keep a given appropriate range, which is a range of 1.5 N to 9 N in the present embodiment, of the feeding pressure that changes depending on the sheet height H and the sheet size, it is insufficient to simply adjust the spring force of the spring 106 serving as an elastic member or uniformly apply the load for reducing the spring force to the receptacle 105 with, for example, a brush-like inclination restraint, regardless of changes in the sheet height H. For example, in a case where the spring force of the spring 106 is simply adjusted in the feeding device 13 having a relationship between the sheet height H (horizontal axis) and the feeding pressure (vertical axis) as indicated by Q1 and Q2 in FIG. 7 to prevent Q1 (A6 size) from being in a multiple-feeding area where the multiple feeding occurs, to set the feeding device 13 so as to have a relationship between the sheet height H (horizontal axis) and the feeding pressure (vertical axis) as indicated by R1 and R2 in FIG. 7, R1 (A6 size) and R2 (A3 size) are partially in a non-feeding area where non-feeding occurs at a relatively small height H.

As described above, in a typical feeding device, as the feeding operation proceeds and changes (reduces) the height of a stack of sheets or the number of sheets stacked on a receptacle, a feeding pressure as a force that presses, against a conveyor, the uppermost sheet of the stack of sheets on the receptacle biased by an elastic member may deviate from an appropriate range. Such an unstable feeding pressure destabilizes the sheet feeding performed by a feeding device.

By contrast, in the present embodiment, as indicated by S1 and S2 in the graph of FIG. 6, the brush 110 serving as a load adjuster reduces the feeding pressure (pickup pressure) as the height H gradually decreases at least when the height H of the stack of sheets P on the receptacle 105 is equal to or greater than the given value Hx, which is about 20 mm in the present embodiment. Accordingly, regardless of the sheet size or changes in the sheet height H, the feeding pressure (pickup pressure) falls within a range (of 1.5 N to 9 N in the present embodiment) that causes neither the multiple feeding nor non-feeding of the sheets P.

In particular, in the present embodiment, the brush 110 serving as a load adjuster applies a reduced magnitude of load downward to the stack of sheets P on the receptacle 105 in response to the decrease in the height H, when the height H of the stack of sheets P on the receptacle 105 is equal to or greater than the given value Hx, which is about 20 mm in the present embodiment.

By contrast, when the height H of the stack of sheets P on the receptacle 105 is less than the given value Hx, which is about 20 mm in the present embodiment, the brush 110 serving as a load adjuster applies no load to the stack of sheets P on the receptacle 105.

Such a configuration increases the margin for the non-feeding when the height H is relatively small and easily allows the feeding pressure (pickup pressure) to fall within a range (of 1.5 N to 9 N in the present embodiment) that causes neither the multiple feeding nor non-feeding of the sheets P, regardless of the sheet height H or the sheet size.

More specifically, referring to FIGS. 3 and 5, the brush 110 as a load adjuster is disposed on each of the fence face 101*a* of the side fence 101 and the fence face 102*a* of the side fence 102.

Since the load of the brush 110 is applied to the stack of sheets P on the receptacle 105 from the opposed widthwise ends of the stack of sheets P in a well-balanced manner, the pickup roller 51 stably feeds the sheets P.

Referring to FIG. 5, the brush 110 is disposed such that bristles 110*b* of the brush 110 are inclined downward, in a direction opposite to a direction in which the receptacle 105 moves up.

Specifically, in the present embodiment, the brush 110 has a substantially rectangular shape and is substantially equivalent to a lint brush. The brush 110 includes the flocked or napped bristles 110*b* made of, for example, nylon. The bristles 110*b* are uniformly inclined in a given direction, which may be referred to as a falling direction in the following direction.

As described above, since the bristles 110*b* are inclined downward, the downward load of the brush 110 is easily applied to the stack of sheets P on the receptacle 105.

The length of the bristles 110*b* of the brush 110 is adjusted by thermal fusion cutting to reduce the collapse of the bristles 110*b*.

Figure 4A:
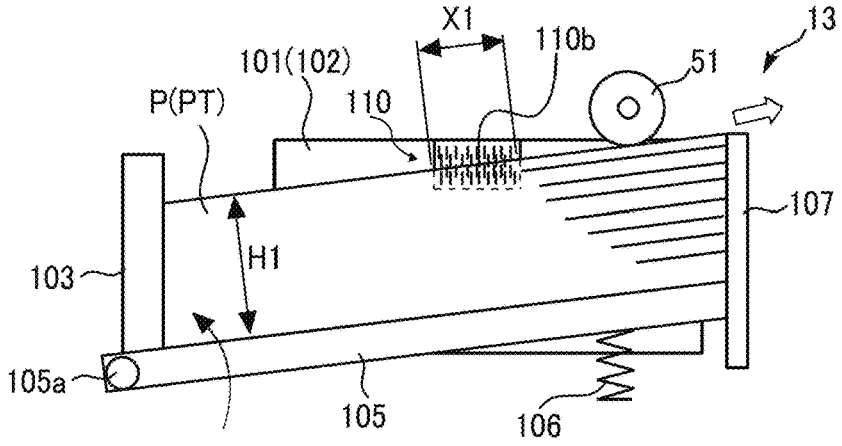
FIGS. 4A to 4C are diagrams each illustrating the feeding device of FIG. 2 along a decrease in the height of a stack of sheets.
Figure 4B:
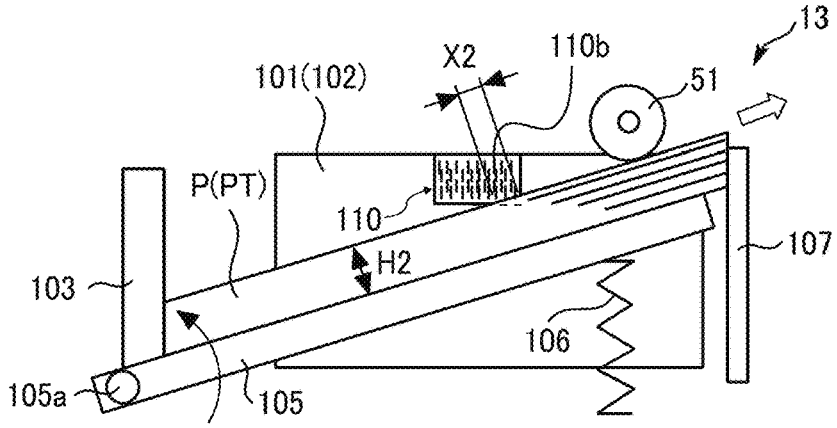
Figure 4C:
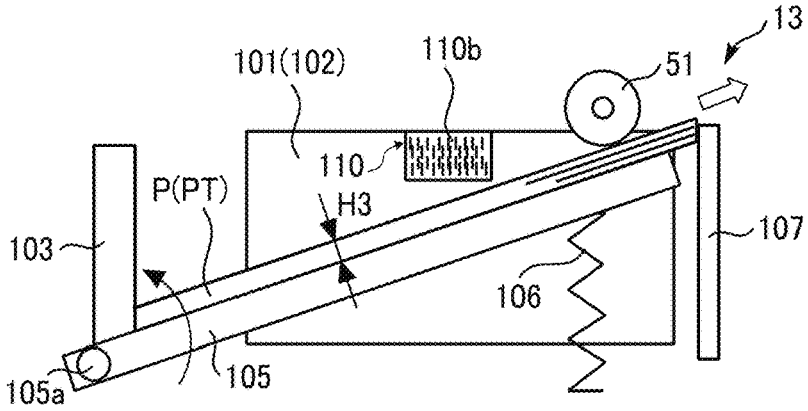

Referring to FIGS. 3 to 4C, the brush 110 is disposed on or attached, via a double-sided adhesive tape, to an upper portion (specifically, a part of the upper portion) of each of the fence faces 101*a* and 102*a* upstream from the pickup roller 51 in the feeding direction, as illustrated to the left of the pickup roller 51 in FIGS. 3 to 4C.

Referring to FIGS. 4A to 4C, the receptacle 105 is pivoted about the pivot 105*a* that is located upstream from the brush 110 in the feeding direction, to move up and down.

In such a configuration, as the sheet feeding is repeated and the height H or the number of sheets P stacked on the receptacle 105 decreases, the pivot angle or inclined angle of the receptacle 105 about the pivot 105*a* increases.

At least when the height H of the stack of sheets P on the receptacle 105 is equal to or greater than the given value Hx, the brush 110 contacts the stack of sheets P on the receptacle 105 in a decreased width X along the feeding direction in response to the decrease in the height H. Note that the width X along the feeding direction is a contact width along a direction along an inclined placement face of the receptacle 105.

Specifically, in the present embodiment, when the sheet height H is equal to or greater than the given value Hx and is a sufficiently large sheet height H1 as illustrated in FIG. 4A, a contact width X1, which is a width along the feeding direction in which the stack of sheets P contacts the brush 110, is greater than a contact width X2 when the sheet height H is the sheet height H2, which is smaller than the sheet height H1, as illustrated in FIG. 4B. In other words, in a case where the sheet height H is equal to or greater than the given value Hx, the load (i.e., the force for reducing the feeding pressure) of the brush 110 on the stack of sheets P on the receptacle 105 decreases as the sheet height H decreases.

By contrast, when the sheet height H is less than the given value Hx and is a sufficiently small sheet height H3 as illustrated in FIG. 4C, the sheet P does not contact the brush 110. In short, the contact width X is 0.

Accordingly, regardless of the sheet height H or the sheet size, the feeding pressure (pickup pressure) falls within a range that causes neither the multiple feeding nor non-feeding of the sheets P.

Preferably, the vertical interval between the adjacent bristles 110*b* of the brush 110 is shorter than the thickness (for example, the basis weight of about 52 g/m$^2$) of a thinnest sheet P that can be fed. In other words, the brush 110 includes the adjacent bristles 110*b* at a vertical interval shorter than the thickness of a thinnest sheet P feedable.

Such a configuration allows the bristles 110*b* of the brush 110 to enter between the sheets P stacked on the receptacle 105 and allows the brush 110 to easily exert the load (i.e., the force for reducing the feeding pressure).

Now, a detailed description is given of the function of the brush 110 serving as a load adjuster.

In the present embodiment, the pressure reduction, which is a reduction of the feeding pressure), performed by the brush 110 as a load adjuster is proportional to the pressing force (i.e., the spring force of the spring 106) for lifting the sheets P on the receptacle 105 and the contact width X in which the sheet P and the brush 110 contact each other.

When the sheet height H is the sufficiently large sheet height H1 as illustrated in FIG. 4A, the contact width X1 in which the sheet P and the brush 110 contact each other is substantially equal to the width of the brush 110. As the sheet height H gradually decreases to the sheet height H2, the contact width X in which the sheet P and the brush 110 contact each other also decreases to the contact width X2 as illustrated in FIG. 4B. As the sheet height H further gradually decreases, the contact width X also gradually decreases and eventually becomes 0 as illustrated in FIG. 4C. Specifically, S1 and S2 in the graph of FIG. 6 indicate a greater decrease in the feeding pressure (pickup pressure) as the height H increases and a smaller decrease in the feeding pressure (pickup pressure) as the height H decreases, from Q1 and Q2, respectively, which indicate a relationship between the feeding pressure (pickup pressure) and the sheet height H in a case where the brush 110 is not disposed. When the height H is less than the given value Hx, the feeding pressure (pickup pressure) is not below Q1 or Q2, as indicated by S1 and S2 overlapping Q1 and Q2, respectively, in the graph of FIG. 6.

In short, the multiple feeding of the sheets P does not occur even when the height H is relatively large whereas the non-feeding of the sheets P does not occur even when the height H is relatively small. Thus, the excellent feeding performance is maintained.

Figure 8A:
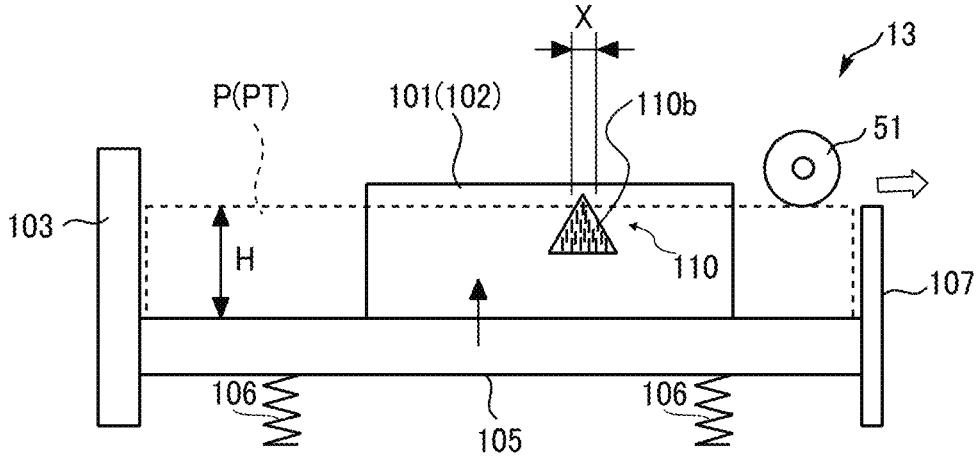
FIG. 8A is a schematic diagram illustrating a feeding device according to a modification of the embodiments of the present disclosure.
Figure 8B:
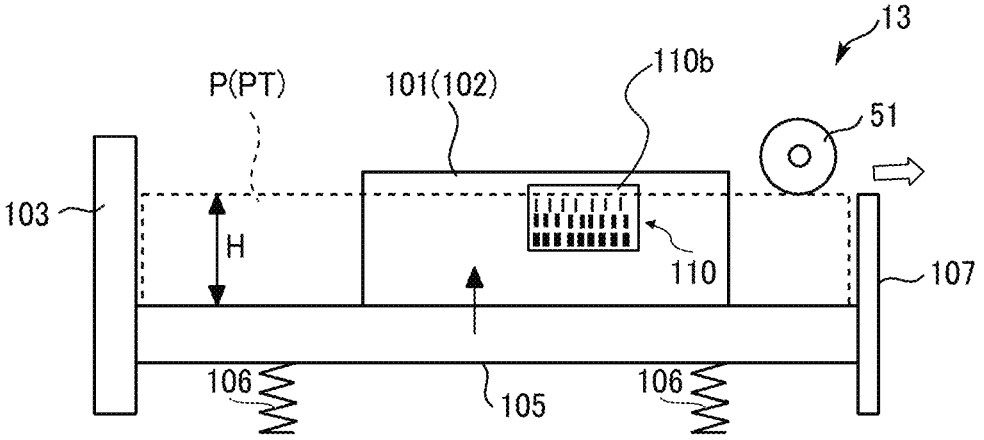
FIG. 8B is a schematic diagram illustrating a feeding device according to another modification of the embodiments of the present disclosure.

Referring now to FIGS. 8A and 8B, a description is given of some modifications of the embodiment described above.

As illustrated in FIGS. 8A and 8B, in the feeding devices 13 according to the modifications, the receptacle 105 moves up and down while keeping the placement face substantially horizontal, instead of being pivoted about the pivot 105*a*.

Like the embodiment described above, according to the modifications illustrated in FIGS. 8A and 8B, the side fences 101 and 102 are disposed as fences including the fence faces 101*a* and 102*a*, respectively, which can contact the end faces of the stack of sheets P (sheet bundle PT) on the receptacle 105. The brush 110 serving as a load adjuster is disposed on each of the fence faces 101*a* and 102*a*.

The brush 110 illustrated in FIG. 8A is substantially a triangle having an upper horizontal width (i.e., the upper width X along the lateral direction in FIG. 8A) smaller than a lower horizontal width (i.e., the lower width X along the lateral direction in FIG. 8A).

On the other hand, in the brush 110 illustrated in FIG. 8B, the stiffness of the bristles 110*b* located above is smaller than the stiffness of the bristles 110*b* located below. In other words, the brush 110 illustrated in FIG. 8B includes the upper bristles 110*b* having a stiffness smaller than the stiffness of the lower bristles 110*b*. Specifically, such a difference in the stiffness of the bristles 110*b* may be caused by changing, for example, the thickness, length, or material of the bristles 110*b*, or a combination thereof. More specifically, for example, the thickness of the bristles 110*b* may be gradually increased downward. The length of the bristles 110*b* may be gradually increased downward. The material of the bristles 110*b* may be changed for each vertical positions to gradually increase the stiffness of the bristles 110*b* downward.

Like the feeding device 13 according to the embodiment described above, each of the feeding devices 13 according to the modifications illustrated in FIGS. 8A and 8B applies, with the brush 110 serving as a load adjuster, a reduced magnitude of load downward to the stack of sheets P on the receptacle 105 in response to the decrease in the height H, at least when the height H of the stack of sheets P on the receptacle 105 is equal to or greater than the given value Hx.

Accordingly, the feeding pressure (pickup pressure) from the uppermost sheet P of the stack of sheets P on the receptacle 105 against the pickup roller 51 is less likely to deviate from the appropriate range in response to changes in the height H of the stack of sheets P on the receptacle 105.

Although the side fences 101 and 102 are used as the fences on each of which the brush 110 is disposed in the present modifications, the reference fence 107 or the end fence 103 may be used as the fence on which the brush 110 is disposed.

As described above, the feeding device 13 according to the present embodiment includes the receptacle 105 that is vertically movable and can hold a stack of sheets P, the pickup roller 51 serving as a conveyor that feeds the uppermost sheet P of the stack of sheets P on the receptacle 105 in the given feeding direction in which a sheet of the stack of sheets P is fed, and the spring 106 serving as an elastic member that biases the receptacle 105 to press the uppermost sheet P of the stack of sheets P on the receptacle 105 against the pickup roller 51. The feeding device 13 according to the present embodiment further includes the brush 110 serving as a load adjuster that applies a reduced magnitude of load downward to the stack of sheets P on the receptacle 105 in response to the decrease in the height H, at least when the height H of the stack of sheets P on the receptacle 105 is equal to or greater than the given value Hx.

Accordingly, the feeding device 13 according to the present embodiment optimizes the feeding pressure (pickup pressure) from the uppermost sheet P of the stack of sheets P on the receptacle 105 against the pickup roller 51, in response to changes in the height H of the stack of sheets P on the receptacle 105.

Although the feeding device 13 is disposed in the image forming apparatus 1 that is a monochrome image forming apparatus in the present embodiment, the feeding device 13 may be disposed in a color image forming apparatus in another embodiment of the present disclosure.

Although the feeding device 13 is disposed in the image forming apparatus 1 that is an electrophotographic image forming apparatus in the present embodiment, the feeding device 13 may be disposed in another type of image forming apparatus such as an inkjet image forming apparatus or a stencil printer in another embodiment of the present disclosure.

Although the feeding device 13 is disposed inside the image forming apparatus 1 in the present embodiment, the feeding device 13 may be used as a feeding device that is exposed to the outside of the image forming apparatus 1, such as a bypass feeding device in another embodiment of the present disclosure. In still another embodiment of the present disclosure, the feeding device 13 may be used as a feeding device that feeds or conveys the document D in the document conveying device 10 as an ADF.

Any of the cases described above exhibits substantially the same advantages as the advantages of the present embodiment.

Although the entire receptacle 105 is vertically movable (pivotable) in the present embodiment, only a part of the receptacle 105 (specifically, a downstream portion of the receptacle 105 in the feeding direction) may be vertically movable (pivotable) in another embodiment of the present disclosure.

Although the pickup roller 51 serving as a roller is used as a conveyor in the present embodiment, the conveyor is not limited to the pickup roller 51. For example, a conveyance belt serving as a belt may be used as the conveyor in another embodiment of the present disclosure.

Although the brush 110 is used as a load adjuster in the present embodiment, the load adjuster is not limited to the brush 110 provided that the load adjuster can apply a load downward to the stack of sheets P on the receptacle 105. For example, the load adjuster may be a film-like member having a relatively high coefficient of friction or a member having a surface with jagged irregularities in another embodiment of the present disclosure. The load adjuster may be a part of the fence face of the fence in one or some embodiments of the present disclosure.

In the present embodiment, the load adjuster reduces the load in response to the decrease in the height H when the sheet height H is equal to or greater than the given value Hx and applies no load when the sheet height H is less than the given value Hx. In a case where a sufficient feeding performance is ensured when the sheet height H is less than the given value Hx, the load adjuster may reduce the load in response to the decrease in the height H.

Any of the cases described above exhibits substantially the same advantages as the advantages of the present embodiment.

In the present description, the sheet P is defined as any sheet-like recording medium, such as general paper, coated paper, label paper, or overhead projector (OHP) transparency.

According to one aspect of the present disclosure, a feeding device is provided that optimizes a feeding pressure from a sheet on a receptacle against a conveyor, in response to changes in the height of a stack of sheets on the receptacle. Also provided is an image forming apparatus incorporating the feeding device.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A feeding device, comprising:

a receptacle vertically movable and configured to hold a stack of sheets;

a conveyor configured to feed an uppermost sheet of the stack of sheets on the receptacle in a feeding direction in which a sheet of the stack of sheets is fed;

an elastic member configured to bias the receptacle to press the uppermost sheet of the stack of sheets on the receptacle against the conveyor;

a load adjuster configured to, at least when a height of the stack of sheets on the receptacle is equal to or greater than a given value, apply a reduced magnitude of load downward to the stack of sheets on the receptacle in response to a decrease in the height of the stack of sheets; and a pair of side fences each including a fence face configured to contact a side end face of the stack of sheets on the receptacle, wherein the load adjuster is a brush disposed on the fence face of each of the side fences, and wherein the brush is configured to contact the stack of sheets on the receptacle in a decreased width along the feeding direction in response to the decrease in the height of the stack of sheets, at least when the height of the stack of sheets on the receptacle is equal to or greater than the given value.

2. The feeding device according to claim 1, wherein the brush includes bristles inclined downward.

3. The feeding device according to claim 1, wherein the brush includes adjacent bristles at a vertical interval shorter than a thickness of a thinnest sheet feedable.

4. The feeding device according to claim 1, wherein the conveyor is a pickup roller, and wherein the brush is disposed on an upper portion of the fence face upstream from the pickup roller in the feeding direction.

5. The feeding device according to claim 4, further comprising a pivot located upstream from the brush in the feeding direction, wherein the receptacle is configured to be pivoted about the pivot to move up and down.

6. The feeding device according to claim 1, wherein the brush is configured to apply no load to the stack of sheets on the receptacle when the height of the stack of sheets on the receptacle is less than the given value.

7. The feeding device according to claim 1, wherein the brush has an upper horizontal width smaller than a lower horizontal width.

8. The feeding device according to claim 1, wherein the brush includes upper bristles having a stiffness smaller than a stiffness of lower bristles.

9. An image forming apparatus comprising the feeding device according to claim 1.

10. A feeding device, comprising:

a receptacle vertically movable and configured to hold a stack of sheets;

a conveyor configured to feed an uppermost sheet of the stack of sheets on the receptacle in a feeding direction in which a sheet of the stack of sheets is fed;

an elastic member configured to bias the receptacle to press the uppermost sheet of the stack of sheets on the receptacle against the conveyor;

a load adjuster configured to, at least when a height of the stack of sheets on the receptacle is equal to or greater than a given value, apply a reduced magnitude of load downward to the stack of sheets on the receptacle in response to a decrease in the height of the stack of sheets; and a pair of side fences each including a fence face configured to contact a side end face of the stack of sheets on the receptacle, wherein the load adjuster is a brush disposed on the fence face of each of the side fences, and wherein the brush includes adjacent bristles at a vertical interval shorter than a thickness of a thinnest sheet feedable.

11. The feeding device according to claim 10, wherein the brush includes bristles inclined downward.

12. The feeding device according to claim 10, wherein the conveyor is a pickup roller, and wherein the brush is disposed on an upper portion of the fence face upstream from the pickup roller in the feeding direction.

13. The feeding device according to claim 10, further comprising a pivot located upstream from the brush in the feeding direction, wherein the receptacle is configured to be pivoted about the pivot to move up and down.

14. The feeding device according to claim 10, wherein the brush is configured to contact the stack of sheets on the receptacle in a decreased width along the feeding direction in response to the decrease in the height of the stack of sheets, at least when the height of the stack of sheets on the receptacle is equal to or greater than the given value.

15. The feeding device according to claim 10, wherein the brush is configured to apply no load to the stack of sheets on the receptacle when the height of the stack of sheets on the receptacle is less than the given value.

16. An image forming apparatus comprising the feeding device according to claim 10.

17. A feeding device, comprising:

a receptacle vertically movable and configured to hold a stack of sheets;

a conveyor configured to feed an uppermost sheet of the stack of sheets on the receptacle in a feeding direction in which a sheet of the stack of sheets is fed;

an elastic member configured to bias the receptacle to press the uppermost sheet of the stack of sheets on the receptacle against the conveyor;

a load adjuster configured to, at least when a height of the stack of sheets on the receptacle is equal to or greater than a given value, apply a reduced magnitude of load downward to the stack of sheets on the receptacle in response to a decrease in the height of the stack of sheets; and a fence including a fence face configured to contact an end face of the stack of sheets on the receptacle, wherein the load adjuster is a brush disposed on the fence face, and wherein the brush has an upper horizontal width smaller than a lower horizontal width.

18. An image forming apparatus comprising the feeding device according to claim 17.

* * * * *